US005645166A

United States Patent [19]

Su

[11] Patent Number: 5,645,166

[45] Date of Patent: Jul. 8, 1997

[54] LOCATING BLOCK OF A GOLF BAG

[76] Inventor: Po-Tang Su, No. 52, Lane 42, Chung Nan Street, Nan Kang District, Taipei, Taiwan

[21] Appl. No.: 670,652

[22] Filed: Jun. 26, 1996

[51] Int. Cl.[6] ..... A63B 55/00

[52] U.S. Cl. ..... 206/315.6; 206/315.3

[58] Field of Search ..... 206/315.2, 315.3, 206/315.6; 220/528, 554

[56] References Cited

U.S. PATENT DOCUMENTS

| | | | |
|---|---|---|---|
| 2,128,546 | 8/1938 | Venmore | 206/315.6 X |
| 3,139,132 | 6/1964 | Shilles | 206/315.6 |
| 4,753,446 | 6/1988 | Mills | 206/315.6 X |
| 5,029,703 | 7/1991 | Dulyea, Sr. | 206/315.3 |
| 5,226,533 | 7/1993 | Antonious | 206/315.6 |
| 5,573,112 | 11/1996 | Kim | 206/315.3 X |

*Primary Examiner*—Allan N. Shoap
*Assistant Examiner*—Christopher J. McDonald
*Attorney, Agent, or Firm*—Varndell Legal Group

[57] ABSTRACT

A locating block mounted in the top cuff of a golf bag for keeping golf clubs in the golf club bag in good order, the locating block including a plurality of partition walls defining a center chamber and a plurality of peripheral chambers around the center chamber, a plurality of outer locating ribs radially projecting into the peripheral chambers for holding golf clubs in the peripheral chambers respectively, and a plurality of inner locating ribs radially projecting into the center chamber for holding golf clubs in the center chambers respectively, each of the outer locating ribs and inner locating ribs having a longitudinal split defining a broad mouth, a narrow tail section, a neck between the mouth and the tail section, and a rounded golf club receiving section between the neck and the tail section for holding a golf club.

1 Claim, 3 Drawing Sheets

LOCATING BLOCK OF A GOLF BAG

BACKGROUND AND SUMMARY OF THE INVENTION

The present invention relates to a locating block adapted for mounting in the top cuff of a golf bag to keep golf clubs in the golf bag in good order.

FIG. 1 shows a locating block adapted for mounting in the top cuff of a golf bag to keep golf clubs in the bag. This locating block comprises a plurality of insertion holes, a plurality of golf club retaining holes, and a plurality of splits respectively connected between the insertion holes and the retaining holes. When the locating block is mounted in the top cuff of the golf bag, golf clubs can be respectively inserted into the insertion holes and then forced sideways to pass through the splits into the golf club retaining holes, permitting the shafts of the golf clubs to be secured to the golf club retaining holes. Because the golf club retaining holes are spaced from one another at a narrow distance, the heads of the golf clubs tend to be forced to hit one another when the golf bag is moved. Furthermore, when moving one golf club from one insertion hole to one golf club retaining hole through one split, much effort should be applied to the golf club.

The present invention provides a locating block for golf bags which eliminates the aforesaid drawbacks. According to the preferred embodiment of the present invention, the locating block comprises a plurality of partition walls defining a center chamber and a plurality of peripheral chambers around the center chamber, a plurality of outer locating ribs radially projecting into the peripheral chambers for holding golf clubs in the peripheral chambers respectively, and a plurality of inner locating ribs radially projecting into the center chamber for holding golf clubs in the center chambers respectively, each of the outer locating ribs and inner locating ribs having a longitudinal split defining a broad mouth, a narrow tail section, a neck between the mouth and the tail section, and a rounded golf club receiving section between the neck and the tail section for holding a golf club. Because the inner and outer locating ribs are properly spaced from one another and not aligned in lines, the, heads of the loaded golf clubs will not be forced to touch one another when the golf bag is moved. Because of the design of the broad mouth and the elongated tail section, a golf club can be forced into engagment with the rounded receiving section with less effort.

DETAILED DESCRIPTION OF THE PREFERRED EMBODIMENT

Figure 1:
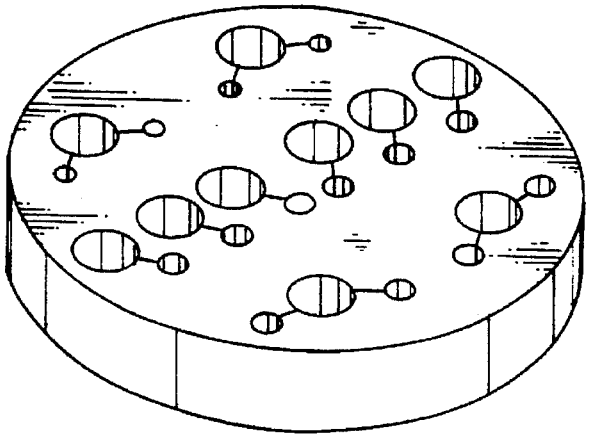
Fig. 1 PRIOR ART
FIG. 1 is an elevational view of a locating block for golf bags according to the prior art.
Figure 2:
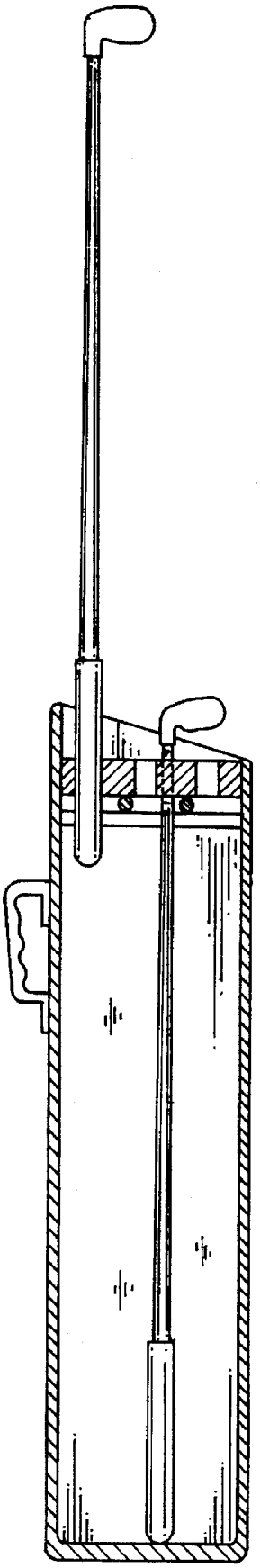
Fig. 2 PRIOR ART
FIG. 2 is a sectional view showing the locating block of FIG. 1 mounted in the top cuff of a golf bag, and golf clubs mounted in the holes in the locating block.
Figure 3:
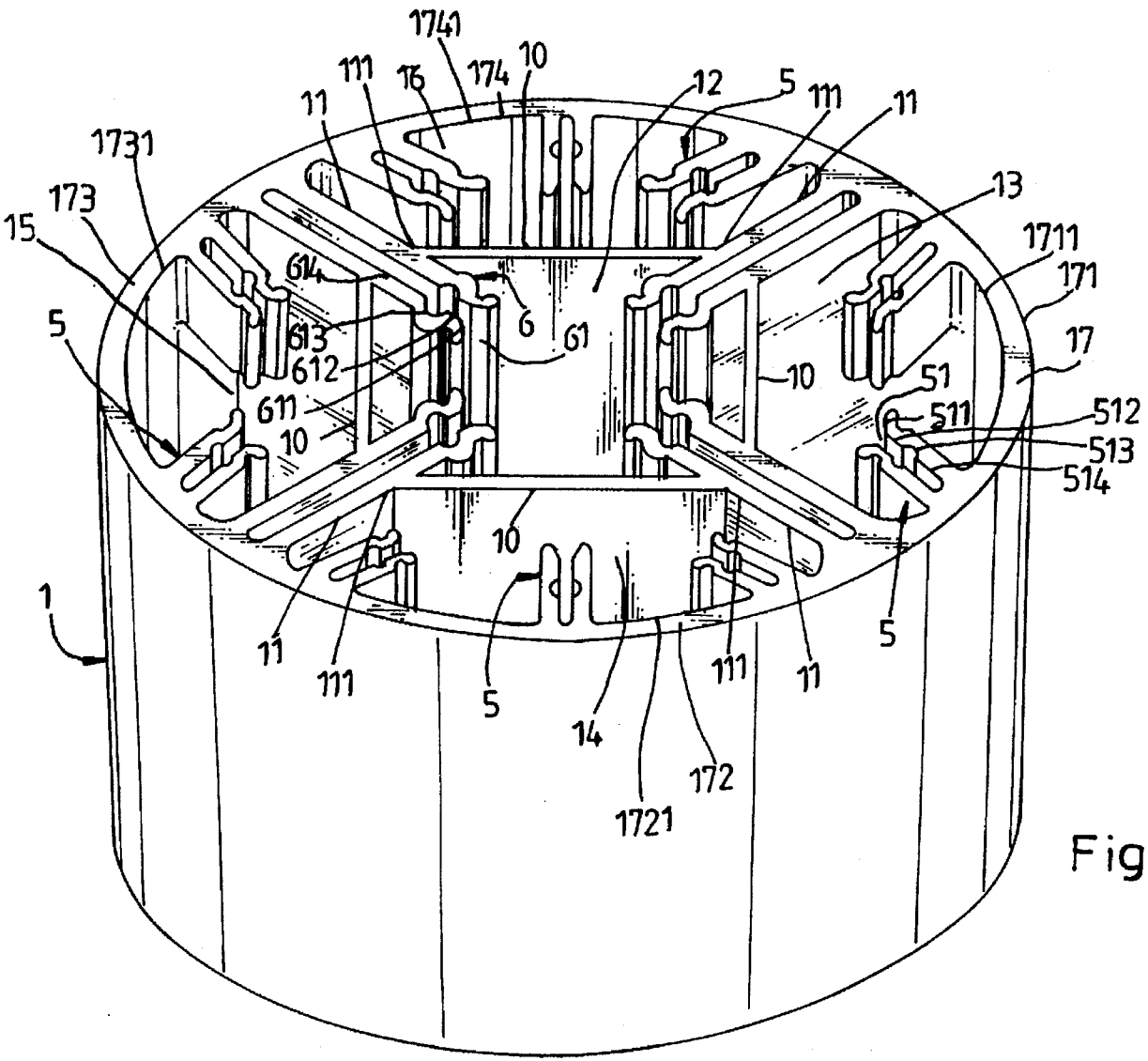
FIG. 3 is an elevational view of a locating block for golf bags according to the present invention.
Figure 4:
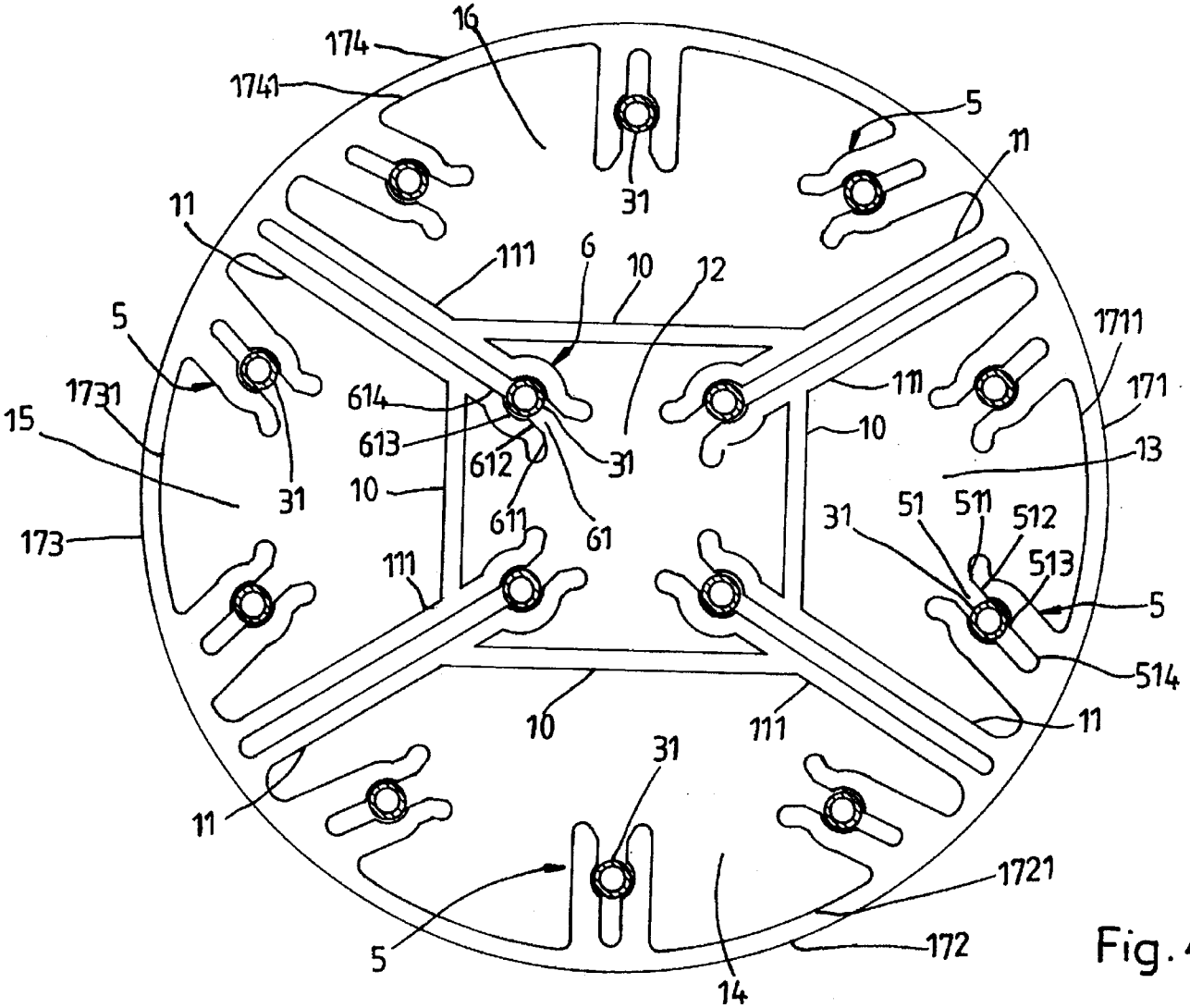
FIG. 4 is a top plan view of the locating block shown in FIG. 3, showing golf clubs mounted in the splits of the locating ribs.

Referring to FIGS. 3 and 4, a locating block in accordance with the present invention is adapated for mounting in the top cuff of a golf bag to keep golf clubs in the golf bag in good order. As illustrated, the locating block 1, comprises a plurality of partition walls 10, 11 defining a plurality of chambers, namely, the center chamber 12, and the peripheral chambers 13, 14, 15, and 16. The center chamber 12 is defined within the partition walls 10. The peripheral chambers 13, 14, 15, and 16 are defined within the peripheral sections 171, 172, 173, and 174 of the periphery 17 and the partition walls 11 around the partition walls 10. A plurality of outer locating ribs 5 are respectively raised from the inside wall 1711, 1721, 1731, 1741 of the periphery 17 and radially projecting into the peripheral chambers 13, 14, 15, and 16 for holding golf clubs. Each of the outer locating ribs 5 has a longitudinal split 51. The longitudinal split 51 of each of the outer locating ribs 5 comprises a broad mouth 511 at the outer end, an elongated narrow tail section 514, a neck 512 between the mouth 511 and the elongated narrow tail sections 514, and a rounded receiving section 513 between the neck 512 and the elongated narrow tail section 514. When a golf club 31 is put in the mouth 511 of one outer locating rib 5, it is forced to pass through the neck 512 into engagement with the rounded receiving section 513. When the golf club 31 is forced inwards to pass from the mouth 511 through the neck 512, the neck 512 is stretched open for permitting the golf club 31 to pass the rounded receiving section 513. When the golf club 31 is moved into engagement with the rounded receiving section 513, the neck 512 immediately returns to its former shape because of the effect of the resilient material property. Further, a plurality of inner locating ribs 6 are respectively raised from the inner ends 111 of the partition walls 11 and radially projecting into the center chamber 12 for holding golf clubs. Each of the inner locating ribs 6 has a longitudinal split 61. The longitudinal split 61 of each of the outer locating ribs 6 comprises a broad mouth 611 at the outer end, an elongated narrow tail section 614, a neck 612 between the mouth 611 and the elongated narrow tail section 614, and a rounded receiving section 613 between the neck 612 and the elongated narrow tail section 614. When one golf club 31 is put in the mouth 611 of one inner locating rib 6, it is forced to pass through the neck 612 into engagement with the rounded receiving section 613. When the golf club 31 is forced inwards to pass from the mouth 611 through the neck 612, the neck 612 is stretched open for permitting the golf club 31 to pass to the rounded receiving section 613. When the golf club 31 is moved into engagement with the rounded receiving section 613, the neck 612 immediately returns to its former shape because of the effect of the resilient material property.

I claim:

1. A locating block mounted in the top cuff of a golf bag for keeping golf clubs in the golf club bag in good order, the locating block comprising: a plurality of first partition walls defining a center chamber, a plurality of second partition walls radially connected between the periphery and said first partition walls and defining a plurality of peripheral chambers around said center chamber, a plurality of outer locating ribs respectively raised from the periphery and radially projecting into said peripheral chambers for holding golf clubs, each of said outer locating ribs having a longitudinal split, the longitudinal split of each of said outer locating ribs comprising a broad mouth at an outer end facing one of said first partition walls, an elongated narrow tail section near the periphery of the locating block, a neck between the mouth and elongated narrow tail section of the respective outer locating rib, and a rounded receiving section between the neck and elongated narrow tail section of the respective outer locating rib and adapated for holding one golf club, and a plurality of inner locating ribs respectively and radially raised from said second partition walls and respectively projecting into said center chamber for holding golf clubs, each of said inner locating ribs having a longitudinal split, the longitudinal split of each of said inner locating ribs comprising a broad mouth at an outer end facing the center of the locating block, an elongated narrow tail section extending into the respective second partition wall, a neck between the mouth and elongated narrow tail section of the respective inner locating rib, and a rounded receiving section between the neck and elongated narrow tail section of the respective inner locating rib and adpated for holding one golf club.

* * * * *